US006277060B1

(12) United States Patent
Neumann

(10) Patent No.: US 6,277,060 B1
(45) Date of Patent: Aug. 21, 2001

(54) CENTRIFUGE CHAMBER FOR A CELL SEPARATOR HAVING A SPIRAL SEPARATION CHAMBER

(75) Inventor: Hans-Jürgen Neumann, St. Wendel (DE)

(73) Assignee: Fresenius AG, Bad Homburg (DE)

( * ) Notice: Subject to any disclaimer, the term of this patent is extended or adjusted under 35 U.S.C. 154(b) by 0 days.

(21) Appl. No.: 09/394,574

(22) Filed: Sep. 10, 1999

(30) Foreign Application Priority Data

Sep. 12, 1998 (DE) ..... 198 41 835

(51) Int. Cl.[7] ..... B04B 7/08
(52) U.S. Cl. ..... 494/37; 494/45
(58) Field of Search ..... 494/10, 18, 37, 494/43, 45, 56; 210/781, 782, 787; 422/72, 101

(56) References Cited

U.S. PATENT DOCUMENTS

| | | | | |
|---|---|---|---|---|
| 3,698,626 | | 10/1972 | Kotrappa et al. . | |
| 4,007,871 | * | 2/1977 | Jones et al. . | |
| 4,010,894 | * | 3/1977 | Kellogg et al. . | |
| 4,278,202 | * | 7/1981 | Westberg . | |
| 4,330,080 | * | 5/1982 | Mathieu . | |
| 4,342,420 | | 8/1982 | Rosemeier et al. . | |
| 4,356,958 | * | 11/1982 | Kolobow et al. . | |
| 4,386,730 | * | 6/1983 | Mulzet | 422/101 |
| 4,387,848 | * | 6/1983 | Kellogg et al. | 494/45 |
| 4,430,072 | * | 2/1984 | Kellogg et al. | 494/45 |
| 4,447,221 | * | 5/1984 | Mulzet | 494/45 |
| 4,479,790 | | 10/1984 | Bocckino et al. . | |
| 4,647,279 | * | 3/1987 | Mulzet et al. | 494/45 |
| 4,708,712 | * | 11/1987 | Mulzet | 494/45 |
| 4,790,807 | * | 12/1988 | Neumann et al. | 494/45 |
| 4,934,995 | * | 6/1990 | Cullis | 494/18 |
| 4,950,401 | * | 8/1990 | Unger et al. | 494/18 |
| 5,006,103 | * | 4/1991 | Bacehowski et al. | 494/45 |
| 5,445,593 | * | 8/1995 | Biesel et al. | 494/43 |
| 5,904,645 | * | 5/1999 | Hlavinka | 494/45 |

FOREIGN PATENT DOCUMENTS

| | | | | |
|---|---|---|---|---|
| 2833911 | * | 2/1979 | (DE) | 494/18 |
| 28 21 055 | | 4/1979 | (DE) . | |
| 42 26 974 | | 2/1994 | (DE) . | |
| 112990 | * | 7/1984 | (EP) | 494/45 |

* cited by examiner

*Primary Examiner*—Charles E. Cooley
(74) *Attorney, Agent, or Firm*—Kenyon & Kenyon

(57) ABSTRACT

A centrifuge chamber of a cell separator having a separation channel with an inlet to introduce the cell suspension and at least one outlet to withdraw a fraction of the cell suspension is described. The cell suspension can be blood. The separation channel is shaped like a spiral extending from the radially outer end of the channel to the radially inner end of the channel, with a progressive slope. The centrifuge chamber allows a uniform, contaminant free separation of the cell suspension into its components.

16 Claims, 5 Drawing Sheets

Progressive Spiral:
R = R0 * ( 1-( Phi/ Phi0 ) ^ y )

Progressive Spiral:
R = R0 * ( 1-( Phi/ Phi0 ) ^ y )

Progressive Spiral:
R = R0 * ( 1-( Phi/ Phi0 ) ^ y1 - Phi/Phi1* y2 )

CENTRIFUGE CHAMBER FOR A CELL SEPARATOR HAVING A SPIRAL SEPARATION CHAMBER

This invention relates to a centrifuge chamber for a cell separator, in particular for separating blood into several fractions.

DESCRIPTION OF THE RELATED ART

Cell separators having a centrifuge chamber are used for separating whole blood into its individual components.

The centrifuge chamber of known cell separators has a separation channel into which the cell suspension to be separated is sent. Under the influence of centrifugal force, the blood is separated in the separation channel into different fractions, such as platelets (PLT), erythrocytes (RBC), platelet-rich plasma (PRP) and platelet-poor plasma (PPP) which are discharged from the chamber.

The centrifuge chamber of known cell separators for separating blood into multiple fractions is generally intended for a single use. One-part and two-part centrifuge chambers are also known. In two-part centrifuge chambers, the separation channel is formed by a flexible film part inserted into a rigid receptacle unit. The separation channel of known one-part or two-part centrifuge chambers is designed with one or more steps.

Centrifuge chambers with a multi-step separation channel have the disadvantage that cells which have already been separated may be entrained into another fraction by turbulent eddies in the transition area between the individual sections of the channel. Thus, for example, there is the risk that platelets which have already been separated might become mixed completely or partially with the plasma, or that leukocytes may be entrained by flow eddies as impurities.

One-step separation chambers, however, have so far been characterized by unclean or inadequate separation of platelets. In particular, this occurs because platelets are obtained from the so-called buffy coat portion of the flow, which also contains a great many leukocytes.

German Patent A-28 21 055 describes a multi-step centrifuge chamber for separating blood into several fractions, whose separation channel consists of several arc-shaped sections with different radii, with a distinct separation between them formed by transitional areas or dams. Each section of the channel has a distinctly different slope, with the slope of the channel section having a discontinuity at the point of transition to the next section connected to it.

A centrifuge chamber whose separation channel is composed of several sections is known from U.S. Pat. No. 4,342,420. This separation channel has an inlet area extending outward, a middle area extending on a circular path around the axis of rotation and an end area extending toward the axis of rotation.

U.S. Pat. No. 4,342,420 discloses a one-step separation chamber with a spiral-shaped separation channel. The separation channel is designed so that it does not extend toward the axis of rotation, but instead it drains in the edge area of the chamber.

SUMMARY OF THE INVENTION

The present invention is directed to centrifuge chamber for a cell separator that substantially obviates one or more of the problems due to limitations and disadvantages of the related art.

The invention includes a centrifuge chamber for a cell separator with a separation channel, that includes at least one channel section bordered by an inner side wall and an outer side wall, the inner side wall being radially closer than the outer side wall to an axis of rotation of the centrifuge chamber, an inlet for introducing a cell suspension in the separation channel, and at least one outlet for withdrawing a fraction of the cell suspension. A path line defining a locus of midpoints between the inner and outer side walls describes each of the channel sections. The path line has a spiral shape extending from a radially outer end of the separation channel to a radially inner end of the separation channel, and has a progressive slope defined for each point of the path line as an angle between a first tangent to a circle about the axis of rotation intersecting the point, and a second tangent to the spiral at the point.

The invention also includes a method for separating a cell suspension into its desired component fractions, comprising the steps of introducing the cell suspension in a separation channel of a separation chamber, and rotating the separation chamber about an axis of rotation, thus forcing the cell suspension to distribute in the separation channel along a spiral shaped path extending from a radially outer end of the separation channel to a radially inner end of the separation channel. The spiral path has a progressively increasing slope defined for each point of the spiral path as an angle between a first tangent to a circle about the axis of rotation intersecting the point, and a second tangent to the spiral path at the point. The method includes also withdrawing the desired component fractions at corresponding outlets disposed on a radially outer surface of the separation channel.

It has been found that a relatively uniform and contamination-free separation of the cell suspension can be achieved with a channel design with a steady path, having a slope that is designed to be constant, or progressively increasing.

Because of the continuous spiral design of the individual sections of the separation channel, there are no discontinuities in the path, and turbulence is prevented so that a laminar flow can develop in the channel.

The separation channel may comprise one or more channel sections, and may have areas between the individual channel sections where fluid enters into the separation chamber or leaves from it. In these areas, the inside and outside walls of the separation channel may not form a steady path.

The centrifuge chamber according to the present invention may be used in particular for separating whole blood into several fractions, namely erythrocytes, platelets, and plasma.

In a preferred embodiment, the invention includes a separation channel that extends up to near the center of the axis of rotation of the centrifuge chamber.

In another preferred embodiment of the centrifuge chamber, the outlet for the erythrocyte fraction is arranged at the radially outer end of the channel, while the outlet for the plasma fraction is arranged at the radially inner end of the channel. The inlet for the cell suspension to be separated is preferably arranged between the outlet for the erythrocyte fraction and the outlet for the plasma fraction. The outlet for the platelet fraction is preferably arranged between the inlet for the blood and the outlet for the plasma fraction.

With this preferred embodiment, the advantages of the centrifuge chamber, whose separation channel has a progressive slope, are especially manifested. Because of the progressively varying slope of the channel, erythrocytes are not packed too compactly in the radially outer areas of the channel. Therefore, the hematocrit value of the erythrocytes in the radially outer areas does not exceed a maximum of 80% to 90%. This is an advantage inasmuch as high hematocrit values in the outer areas of the channel interfere with a radially inward flow of platelets into the plasma. In addition, this ensures that plasma can flow unhindered radially inward to the plasma outlet over the entire length of the channel.

Since the slope of the path increases progressively with a reduction in centrifugal force, platelets can fall back to the platelet outlet from inner areas of the channel, due to the centrifugal force.

In another preferred embodiment, the outlet for platelets is arranged in a recess which is located on the radially outside wall of the channel and extends over the entire height of the separation channel. The platelets can be removed from this recess with a high efficiency. Both of the platelets which are entrained by the plasma flow from the buffy coat layer on the erythrocytes to the plasma outlet, as well as the platelets that fall back from radially inner areas due to the progressive slope of the channel, may fall into this recess.

The outlet for platelets is advantageously located in the lower half of the recess, preferably in the radially outer part of the recess.

The separation channel with the erythrocyte outlet on the radially outer end and with the plasma outlet on the radially inner end can be easily vented when it is pre-filled with solutions or blood, because the air bubbles are driven under the influence of centrifugal force to the radially inner end, where they can be removed without residue through the plasma outlet.

The cross-section of the separation channel preferably is constant over its entire length. However, it is also possible to provide a separation channel with a cross-section that changes steadily in the longitudinal direction.

The centrifuge chamber may be designed as a one-piece chamber, with the centrifuge channel being part of the housing body. However, it is also possible to design the centrifuge chamber in two parts, with the separation channel being inserted into the housing body as a flexible channel made of a tubing or film material.

It is to be understood that both the foregoing general description and the following detailed description are exemplary and explanatory and are intended to provide further explanation of the invention as claimed.

DETAILED DESCRIPTION OF THE EMBODIMENTS

Figure 1:
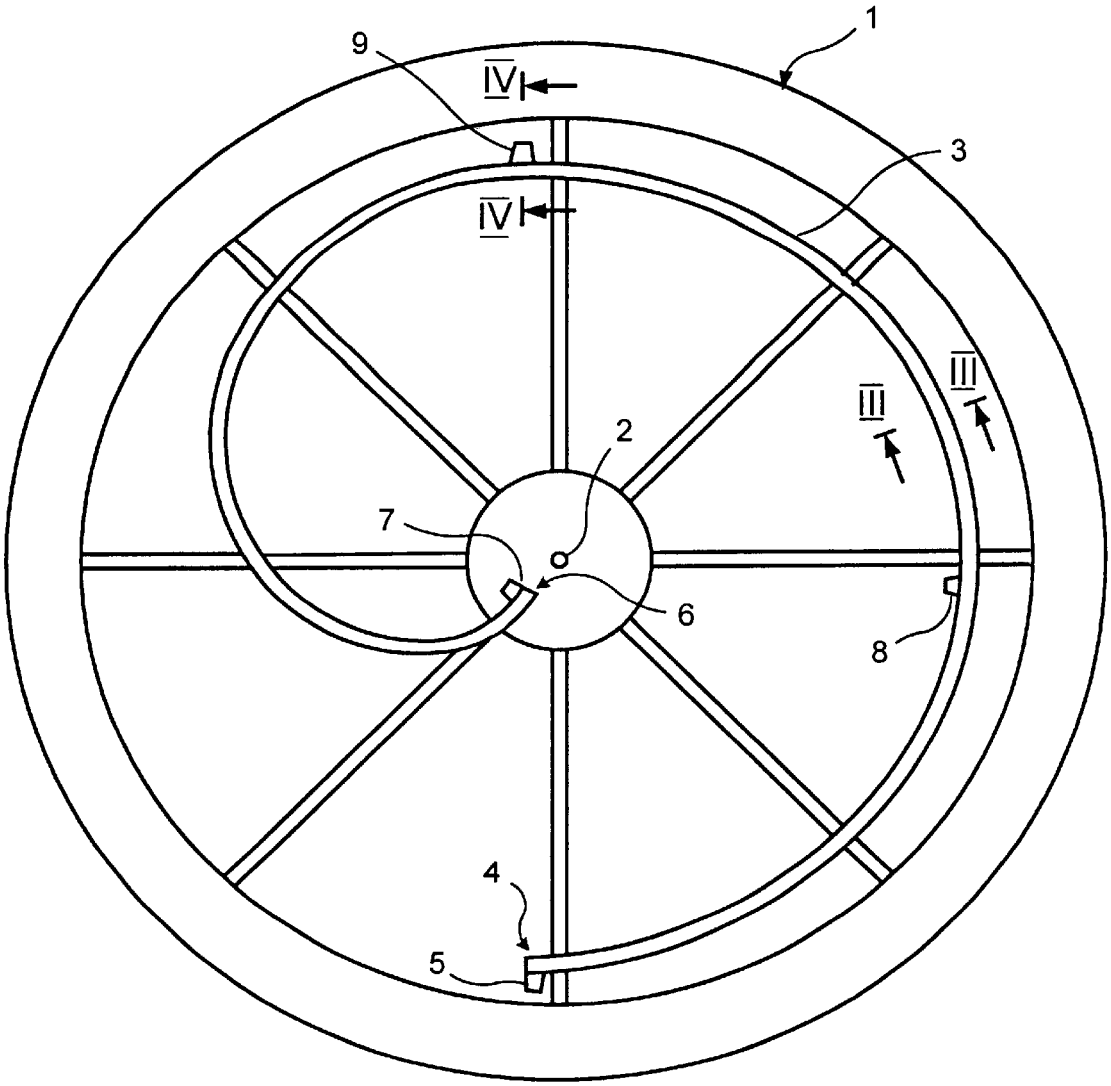
FIG. 1 is a schematic top view of a centrifuge chamber according to the invention.

One embodiment according to the invention is described with reference to FIGS. 1 to 4. The centrifuge chamber has a circular housing body 1 which can be inserted into a cell separator. Housing body 1 rotates about a vertical axis of rotation 2 in the cell separator. Housing body 1 has a separation channel 3 which extends around axis of rotation 2 of the centrifuge chamber.

At its outer end 4, the separation channel 3 has a first outlet 5 for erythrocytes (RBC). A second outlet 7 for plasma (PLS) is located at the inner end 6 of separation channel 3. Between erythrocyte outlet 5 and plasma outlet 7, separation channel 3 has an inlet 8 for inserting the whole blood (WB) to be separated. A third outlet 9 for platelets (PLT) is arranged between whole blood inlet 8 and plasma outlet 7. The inlet and outlets are preferably distributed at essentially uniform intervals over the length of the channel.

Figure 3:
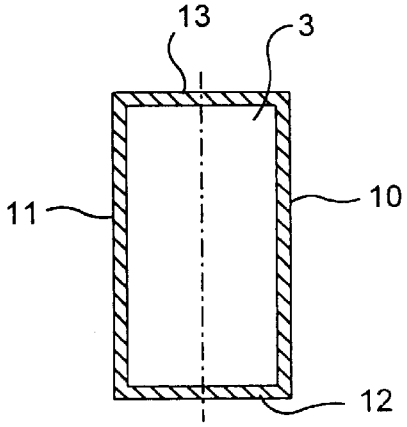
FIG. 3 is a cross-sectional view of a separation channel of the centrifuge chamber of FIG. 1, on line III—III.

The path of separation channel 3 and the arrangement of the inlet and outlet connections for supply and removal of whole blood and its fractions is described in detail below, with reference to FIGS. 2 through 4.

Separation channel 3 preferably has a uniform cross-section along its length. It is bordered by a side wall 10 on the inside and a side wall 11 on the outside, plus a lower wall 12 and an upper wall 13 (FIG. 3).

The path of separation channel 3 is described by a center line extending in the middle between side walls 10, 11, winding in the shape of a spiral S about axis of rotation 2 of the centrifuge chamber and extending toward the axis of rotation.

The slope of the spiral center line S describing the path of the rotating channel increases steadily from the outer end 4 of the channel to the inner end 6 of the channel. The slope at a point on the spiral is defined as the angle between the tangent of a circle about the axis of rotation at that point and the tangent of the spiral at that point.

Figure 2:
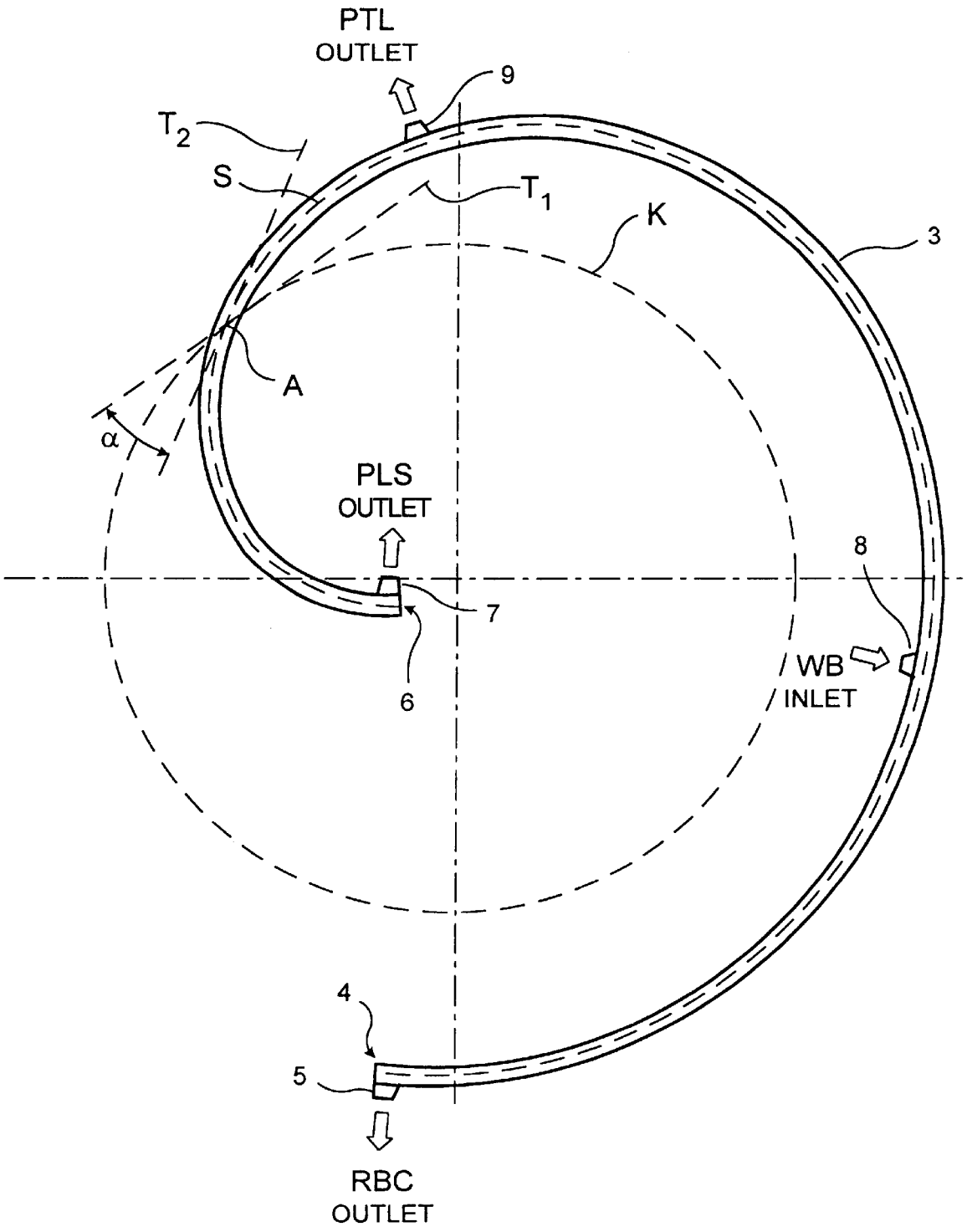
FIG. 2 is a top view of the separation channel path of the centrifuge chamber shown in FIG. 1.

FIG. 2 shows a point labeled A on the spiral S describing the path of the separation channel. The circle centered on axis of rotation 2 of the centrifuge chamber on which point A is located is labeled K. The slope at point A is defined as the angle alpha between the tangent T1 of circle K at point A and tangent T2 of spiral S describing the course of the channel at point A. The slope at other points on spiral S can be computed using the same construction.

The path of separation channel 3 is described by the following equation:

$$R=R0(1-(phi/phi0)^{y})$$

where

R=radial coordinate of spiral S describing the path of the channel at point phi

R0=greatest distance radially of spiral S describing the path of the channel at the outer beginning of the channel phi=angular coordinate of the channel point in question phi0=total angular extent of the channel y=continuity parameter In a preferred embodiment, spiral S describing the path of the channel has a slope less than 5 degrees over essentially the first half of its length, starting from the outer end 4 of the channel, and has a slope greater than 5 degrees in the second half. Preferably, the continuity parameter y is less than 1500.

Whole blood inlet 8 is preferably located at a point in the channel where the slope is less than 1 degree, while platelet outlet 9 is preferably located at a point in the channel where the slope is greater than 5 degrees.

During operation, whole blood is supplied through inlet 8 of the chamber, while erythrocytes are removed through outlet 5, plasma is removed through outlet 7, and platelets are removed through outlet 9. Because of the progressively increasing slope, platelets can fall back from more inner areas of the channel to the platelet outlet. The position of the separation line between erythrocytes and platelet-rich plasma is adjusted by varying the draw-off rate of the pump used for removing the plasma from the separation channel, so that the outlet 9 for platelets is located at a further inward radially than the separation line.

Figure 4:
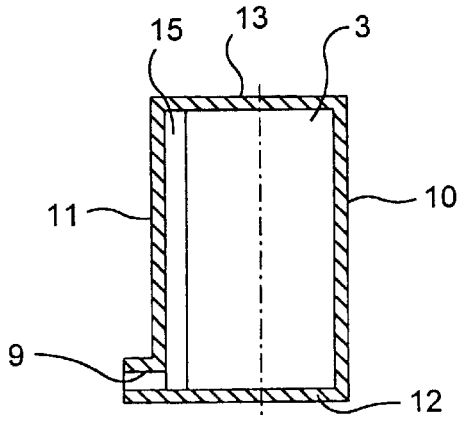
FIG. 4 is a cross-sectional view of a separation channel of the centrifuge chamber of FIG. 1, on line IV—IV.

FIG. 4 shows a cross section of separation channel 3 at the position where platelet outlet 9 is located. The outer side wall 11 is curved to have a concave portion that extends radially outward, and then again radially inward, forming a recess 15. At the bottom of the recess 15, platelet outlet 9 is disposed on the outer side wall.

Recess 15 is formed over the entire height of the channel to ensure that the channel cross section does not change significantly with regard to flow conditions, and that there is laminar flow over the outlet.

The outside wall of the outer section of the separation channel develops into a wall that runs obliquely downward and is connected to a second wall that runs radially inward, and then develops into the chamber section disposed radially inward. The drain port for the platelets is located at the point along the separation channel where the two walls meet.

Both the platelets entrained by the plasma flow from the buffy coat layer on the erythrocytes to plasma outlet 7, as well as the platelets that fall back from the radially inner areas due to the progressive slope of the channel, fall into recess 15.

Figure 5:
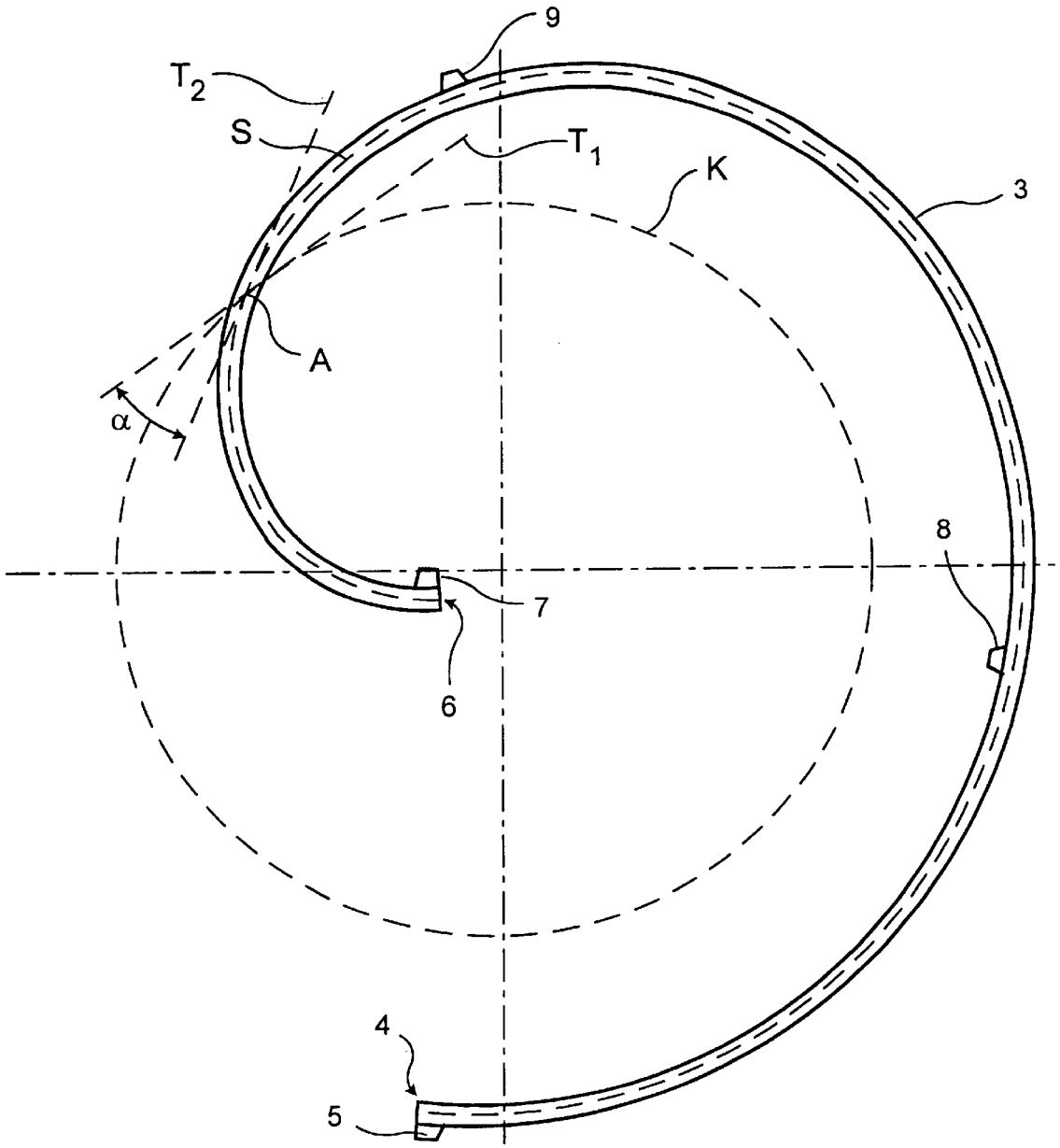
FIG. 5 is a diagram of a separation channel path of a centrifuge chamber according to a second embodiment of the invention.

FIG. 5 shows the path of the separation channel according to another embodiment of the invention, with corresponding elements labeled with the same reference numerals. Spiral S describing the path center line of the separation chamber is described by the following equation:

$$R=R0(1-(\text{phi}/\text{phi}0)^{y1}-\text{phi}/\text{phi}1\cdot y2)$$

where

R=radial coordinate of the spiral describing the path of the separation channel at point phi R0=greatest channel distance radially at the outer beginning of the channel phi=angular coordinate of the channel point in question phi0=total angular extent of the channel phi1=angle parameter y1=slope parameter 1 y2=slope parameter 2

In a preferred example, slope parameter y1 is less than 1500, and slope parameter y2 is less than 10, with phi1/phi0 being preferably greater than 0.3.

Figure 6:
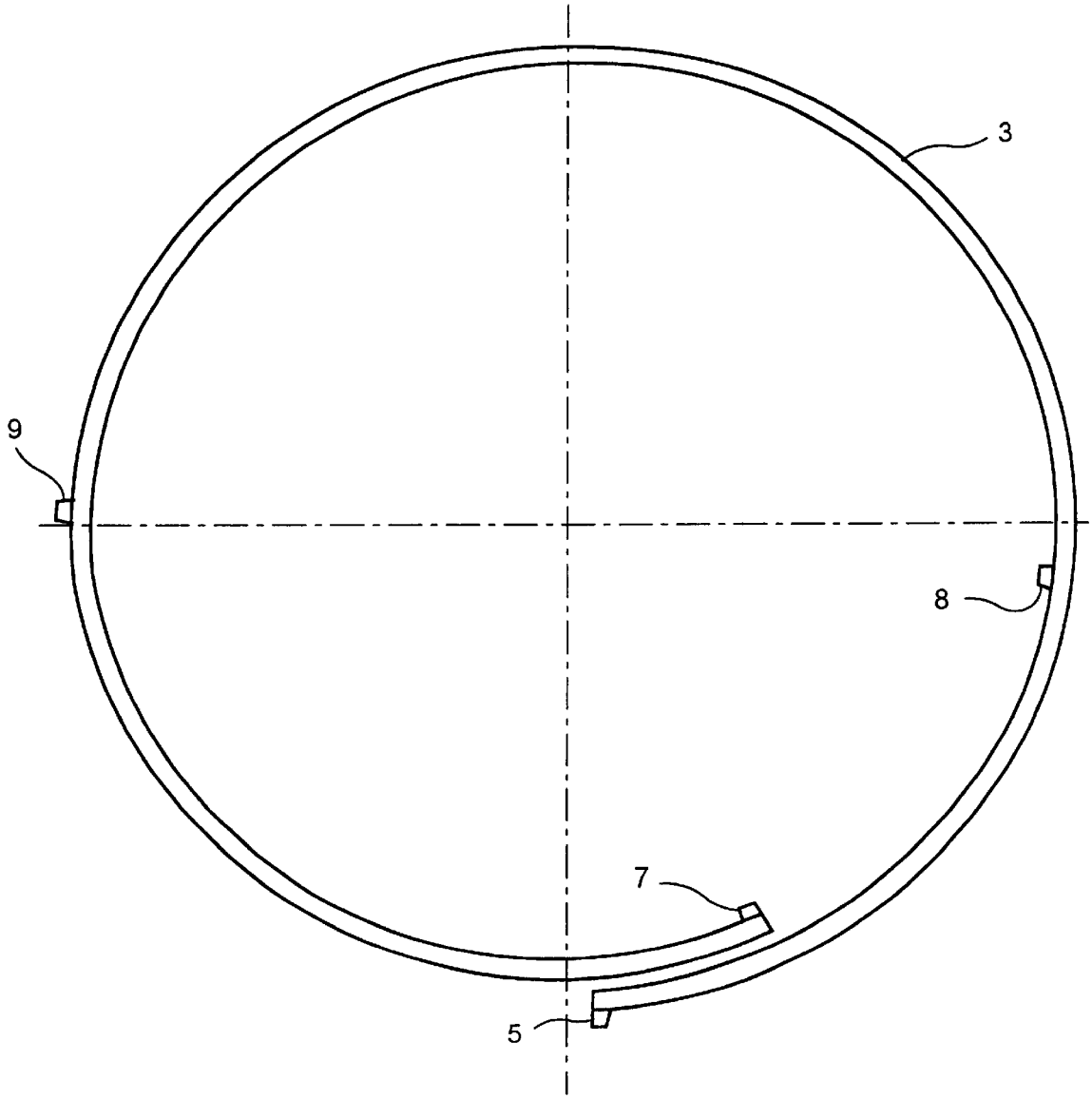
FIG. 6 is a diagram of a separation channel path of a centrifuge chamber according to a third embodiment of the invention.

FIG. 6 shows another embodiment of the invention, having a path of a separation channel 3 with a progressive slope, described by the equation:

$$R=R0-y1/\text{phi}1\cdot\text{phi}+(1/(y3\hat{}((\text{phi}-\text{phi}3)/(\text{phi}+1))+1)-1)/y2\cdot\text{phi},$$

where

R=radial coordinate of the channel distance phi1=angle parameter 1 y2=slope parameter 2 y1=circle deviation at phi1 phi0=total angular extent y3=steepness phi3=progressive section phi=angular coordinate of the channel point in question In addition, in this embodiment the channel may have an angular extent of greater than 360 degrees.

Figure 7:
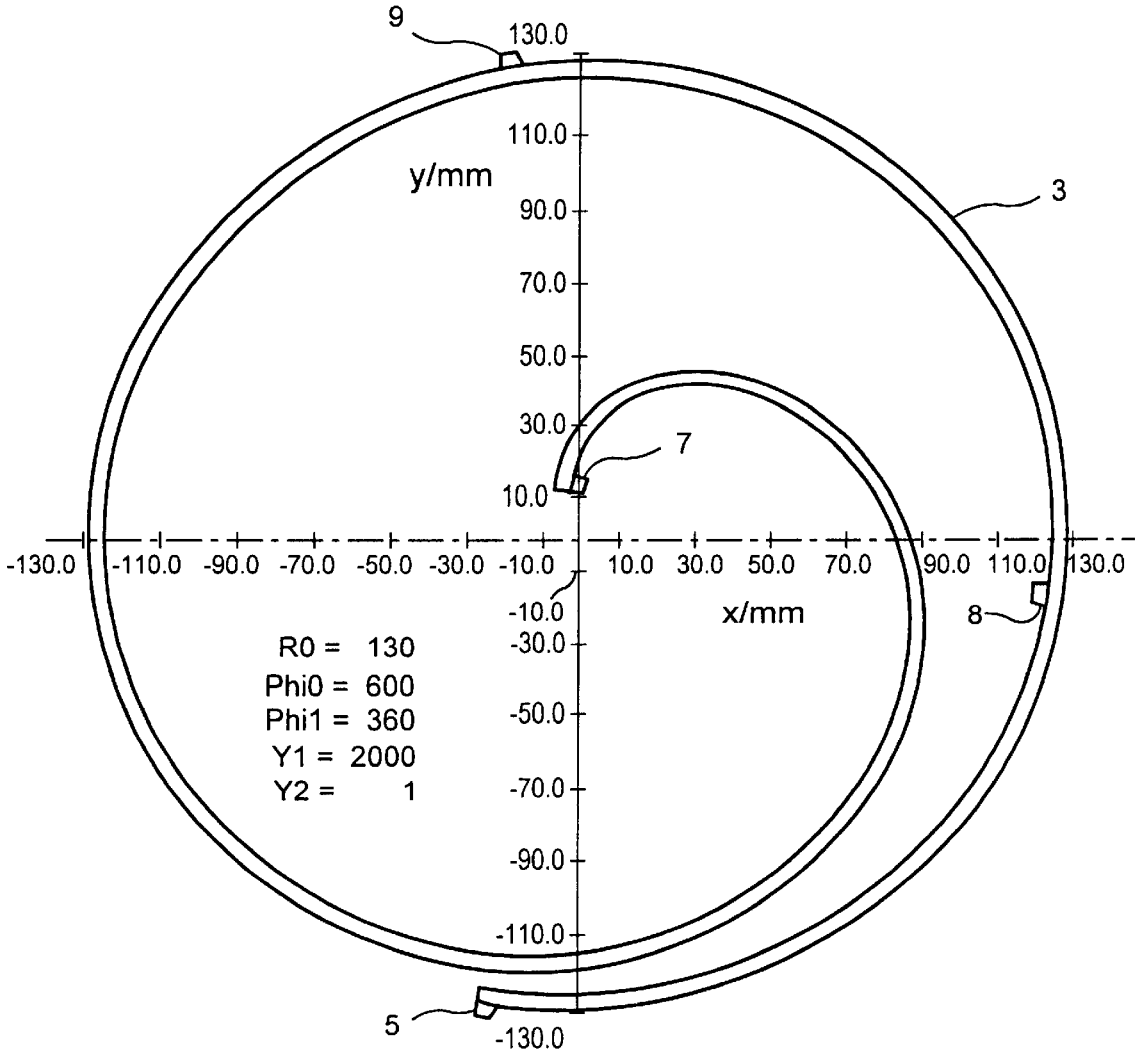
FIG. 7 is a diagram of a separation channel path of a centrifuge chamber according to a fourth embodiment of the invention.

FIG. 7 shows the path of separation channel 3 according to a further embodiment of the invention. Here, channel 3 has a very low slope over 270 degrees of its extent, increasing progressively up to 540 degrees of extent. A separation channel with such a shape is suitable for obtaining a very platelet-rich plasma, which is removed at the radially innermost point.

It will be apparent to those skilled in the art that various modifications and variations can be made in the structure and the methodology of the present invention, without departing from the spirit or scope of the invention. Thus, it is intended that the present invention cover the modifications and variations of this invention provided they come within the scope of the appended claims and their equivalents.

What is claimed is:

1. A centrifuge chamber for a cell separator having a separation channel comprising:

at least one channel section bordered by an inner side wall and an outer side wall, the inner side wall being radially closer than the outer side wall to an axis of rotation of the centrifuge chamber;

an inlet for introducing a cell suspension in the separation channel; and at least one outlet for withdrawing a fraction of the cell suspension, wherein a path line defining a locus of midpoints between the inner and outer side walls describes the at least one channel section, the path line having a spiral shape extending from a radially outer end of the separation channel to a radially inner end of the separation channel, having a progressively varying slope defined for each point of the path line as an angle between a first tangent to a circle about the axis of rotation intersecting the point, and a second tangent to the spiral at the point.

2. The centrifuge chamber according to claim 1, wherein a first slope of a first portion of the path line describing a radially outer channel section is less than a second slope of a second portion of the path line describing a radially inner channel section, adjacent to the radially outer channel section.

3. The centrifuge chamber according to claim 1, wherein the separation channel extends to a point adjacent to the axis of rotation of the centrifuge chamber.

4. The centrifuge chamber according to claim 1, wherein a first outlet of the at least one outlet, adapted to withdraw an erythrocyte fraction of the cell suspension, is disposed at a radially outer end of the separation channel.

5. The centrifuge chamber according to claim 1, wherein a second outlet of the at least one outlet, adapted for withdrawing a plasma fraction of the cell suspension, is disposed at a radially inner end of the separation channel.

6. The centrifuge chamber according to claim 1, wherein the inlet is disposed between a radially inner end of the separation channel and a radially outer end of the separation channel.

7. The centrifuge chamber according to claim 6, wherein a third outlet of the at least one outlet, adapted for withdrawing a platelet fraction of the cell suspension, is disposed between the inlet and the radially inner end of the separation channel.

8. The centrifuge chamber according to claim 7, wherein the third outlet is disposed in a recess formed in the outer side wall and extending substantially over a height of the outer side wall of the separation channel.

9. The centrifuge chamber according to claim 1, wherein the inlet and the at least one outlet are distributed at substantially uniform intervals along the separation channel.

10. The centrifuge chamber according to claim 1, wherein a first portion of the path line has a slope of less than 5 degrees, and a second portion of the path line has a slope greater than 5 degrees, the first portion extending substantially over a radially outer half of the separation channel.

11. The centrifuge chamber according to claim 1, wherein the separation channel has a substantially uniform cross section.

12. The centrifuge chamber according to claim 1, wherein the cell suspension is blood.

13. The centrifuge chamber according to claim 1, wherein the path line has the equation:

$$R=R0(1-/(phi/phi0)^{y})$$

where

R=radial coordinate of spiral S describing the path of the channel at point phi

R0=greatest distance radially of spiral S describing the path of the channel at the outer beginning of the channel phi=angular coordinate of the channel point in question phi0=total angular extent of the channel y=continuity parameter.

14. The centrifuge chamber according to claim 1, wherein the path line has the equation:

$$R=R0(1-(phi/phi))^{y1}-phi/phi1\cdot y2$$

where

R=radial coordinate of the spiral describing the path of the separation channel at point phi R0=greatest channel distance radially at the outer beginning of the channel phi=angular coordinate of the channel point in question phi0=total angular extent of the channel phi1=angle parameter coordinate of the channel point in question phi0=total angular extent of the channel phi1=angle parameter y1=slope parameter 1 y2=slope parameter 2.

15. The centrifuge chamber according to claim 1, wherein the path line has the equation:

$$R=R0-y1/\text{phi1}\cdot\text{phi}+(1/y3\hat{}(\text{phi}-\text{phi3})/\ (\text{phi}+1)0=1)-1/y^{2}\cdot\text{phi}$$

where

R=radial coordinate of the channel distance

R0=greatest channel distance radially at the outer beginning of the channel phi1=angle parameter 1 y2=slope parameter 2 y1=circle deviation at phi1 phi0=total angular extent y3=steepness phi3=progressive section phi=angular coordinate of the channel point in question.

16. A method for separating a cell suspension in its desired component fractions, comprising the steps of:

introducing the cell suspension in a separation channel of a separation chamber;

rotating the separation chamber about an axis of rotation thus forcing the cell suspension to distribute in the separation channel along a spiral shaped path extending from a radially outer end of the separation channel to a radially inner end of the separation channel, having a progressively increasing slope defined for each point of the spiral path as an angle between a first tangent to a circle about the axis of rotation intersecting the point, and a second tangent to the spiral path at the point; and withdrawing the desired component fractions at corresponding outlets disposed on a wall of the separation channel.

* * * * *